US009151102B2

(12) United States Patent
Debus et al.

(10) Patent No.: US 9,151,102 B2
(45) Date of Patent: Oct. 6, 2015

(54) CABLE DEFLECTING PIECE FOR A CABLE OPERATED WINDOW LIFTER

(75) Inventors: Bruno Debus, Sucy (FR); Christian Dallos, Hallstadt (DE); Craig Kinnell, Coburg (DE)

(73) Assignee: Brose Fahrzeugteile GmbH & Co. KG, Hallstadt, Hallstadt (DE)

( * ) Notice: Subject to any disclaimer, the term of this patent is extended or adjusted under 35 U.S.C. 154(b) by 0 days.

(21) Appl. No.: 13/821,545

(22) PCT Filed: Aug. 23, 2011

(86) PCT No.: PCT/EP2011/064452

§ 371 (c)(1),
(2), (4) Date: Mar. 20, 2013

(87) PCT Pub. No.: WO2012/031888

PCT Pub. Date: Mar. 15, 2012

(65) Prior Publication Data

US 2013/0168488 A1 Jul. 4, 2013

(30) Foreign Application Priority Data

Sep. 8, 2010 (DE) ..... 20 2010 012 567.7

(51) Int. Cl.
*E05F 11/44* (2006.01)
*E05F 7/00* (2006.01)
*E05F 11/48* (2006.01)

(52) U.S. Cl.
CPC ..... *E05F 7/00* (2013.01); *E05F 11/483* (2013.01); *E05Y 2201/654* (2013.01);
(Continued)

(58) Field of Classification Search
USPC ..... 49/352, 348, 349; 242/615.3
See application file for complete search history.

(56) References Cited

U.S. PATENT DOCUMENTS 4,502,247 A * 3/1985 Kobayashi et al. ..... 49/352
4,515,035 A * 5/1985 Kuster ..... 74/502.4

(Continued)

FOREIGN PATENT DOCUMENTS

CN 100999969 A 7/2007
CN 101680259 A 3/2010

(Continued)

OTHER PUBLICATIONS

International Search Report, corresponding to PCT/EP2011/064452, dated Nov. 2, 2011, 4 pages.

(Continued)

*Primary Examiner* — Katherine Mitchell
*Assistant Examiner* — Shiref Mekhaeil
(74) *Attorney, Agent, or Firm* — Christie, Parker & Hale, LLP

(57) ABSTRACT

A cable deflecting piece, which is fastened on a rail head or rail foot of a guide rail and is intended for a cable operated window lifter, contains a base body which during mounting and following fastening of the cable deflecting piece, abuts against the guide rail on one side of the rail head or rail foot, also contains a rotary and bearing pin, which projects from the base body, can be inserted in a position in which it is tilted in relation to the longitudinal extension of the guide rail, into a rotary and bearing opening of the rail head or rail foot and can be pivoted about a cable deflecting piece, further contains a rotation prevention means which, in a final mounting position, once the cable deflecting piece has been pivoted about the mounting axis of rotation, secures the connection of the cable deflection piece to the rail head or rail foot such that the cable deflecting piece cannot rotate and additionally contains a device which is formed on the basic body and is intended for securing the abutment of the base body against the rail head or rail foot perpendicular to the longitudinal extension of the guide rail.

18 Claims, 6 Drawing Sheets

(52) U.S. Cl.
CPC ..... *E05Y 2201/66* (2013.01); *E05Y 2201/662* (2013.01); *E05Y 2600/528* (2013.01); *E05Y 2600/56* (2013.01); *E05Y 2600/60* (2013.01)

(56) References Cited

U.S. PATENT DOCUMENTS

| | | | | | |
|---|---|---|---|---|---|
| 4,829,711 | A * | 5/1989 | Sambor | 49/211 |
| 4,835,907 | A * | 6/1989 | Heuchert | 49/352 |
| 5,081,792 | A * | 1/1992 | Huebner | 49/221 |
| 5,367,827 | A * | 11/1994 | Tajima et al. | 49/352 |
| 5,581,952 | A * | 12/1996 | Kapes et al. | 49/502 |
| 5,606,827 | A * | 3/1997 | Kanou et al. | 49/352 |
| 5,778,600 | A * | 7/1998 | Chu | 49/352 |
| 5,809,695 | A * | 9/1998 | Strickland | 49/352 |
| 5,890,321 | A * | 4/1999 | Staser et al. | 49/502 |
| 5,937,584 | A * | 8/1999 | Salmonowicz et al. | 49/502 |
| 5,970,658 | A * | 10/1999 | Smith | 49/352 |
| 6,052,947 | A * | 4/2000 | Smith | 49/352 |
| 6,584,731 | B2 * | 7/2003 | Arquevaux et al. | 49/352 |
| 6,688,043 | B1 * | 2/2004 | Feder et al. | 49/352 |
| 7,201,081 | B2 * | 4/2007 | Mossler | 74/502.4 |
| 7,472,737 | B1 * | 1/2009 | Rachkov | 156/539 |
| 7,596,907 | B2 * | 10/2009 | Huge et al. | 49/352 |
| 7,596,908 | B2 * | 10/2009 | Rothe et al. | 49/374 |
| 7,617,633 | B2 * | 11/2009 | Shimura et al. | 49/349 |
| 7,774,985 | B2 * | 8/2010 | Miyagawa et al. | 49/360 |
| 7,882,658 | B2 * | 2/2011 | Staser et al. | 49/352 |
| 7,950,185 | B2 * | 5/2011 | Lefevre et al. | 49/352 |
| 7,958,676 | B2 * | 6/2011 | Kruger | 49/352 |
| 7,975,434 | B2 * | 7/2011 | Smith | 49/352 |
| 8,065,835 | B2 * | 11/2011 | Hansel et al. | 49/374 |
| 8,127,496 | B2 * | 3/2012 | Maruyama et al. | 49/352 |
| 8,402,694 | B2 * | 3/2013 | Daumal Castellon | 49/352 |
| 2002/0139051 | A1 | 10/2002 | Arquevaux et al. | |
| 2004/0187389 | A1 * | 9/2004 | Santaolalla Gil et al. | 49/352 |
| 2006/0037247 | A1 * | 2/2006 | Heyer et al. | 49/352 |
| 2007/0163178 | A1 | 7/2007 | Lefevre et al. | |
| 2008/0244981 | A1 * | 10/2008 | Arimoto | 49/352 |
| 2011/0010999 | A1 * | 1/2011 | Broadhead et al. | 49/352 |
| 2011/0225888 | A1 * | 9/2011 | Aschmutat et al. | 49/352 |

FOREIGN PATENT DOCUMENTS

| | | | |
|---|---|---|---|
| DE | 80 32 764 | U1 | 6/1981 |
| DE | 38 05 576 | C2 | 11/1988 |
| DE | 39 06 682 | C2 | 9/1990 |
| DE | 196 15 589 | A1 | 1/1997 |
| DE | 197 56 668 | C1 | 2/1999 |
| DE | 20 2006 014 697 | U1 | 3/2008 |
| DE | 10 2007 048 173 | A1 | 4/2008 |
| EP | 1 243 733 | A1 | 9/2002 |
| EP | 1 491 708 | A1 | 12/2004 |
| WO | WO 2008/034853 | A1 | 3/2008 |
| WO | WO 2008/152155 | A1 | 12/2008 |
| WO | WO 2009/047373 | A1 | 4/2009 |

OTHER PUBLICATIONS

English translation of the International Preliminary Report on Patentability corresponding to PCT/EP2011/064452, dated Mar. 12, 2013, 7 sheets.

Russian Decision for Application No. 2013108725/12, 9 sheets.

English translation of Chinese Office action for Application No. 201180043410.9, dated Jun. 25, 2014, 5 sheets.

European examination report for Application No. 11 761 525.2, dated Jul. 23, 2014, 5 sheets and English translation of the pertinent parts, 3 sheets.

Office action for Korean Application No. 10-2013-7007895, dated Oct. 31, 2014, 3 sheets.

European examination report for Application No. 11 761 525.2, dated Jul. 23, 2014, 5 sheets.

* cited by examiner

CABLE DEFLECTING PIECE FOR A CABLE OPERATED WINDOW LIFTER

CROSS-REFERENCE TO A RELATED APPLICATION

This application is a National Phase Patent Application of International Patent Application Number PCT/EP2011/064452, filed on Aug. 23, 2011, which claims priority of German Utility Model Application Number 20 2010 012 567.7, filed on Sep. 8, 2010.

BACKGROUND

The invention relates to a cable deflecting piece for a cable operated window lifter which comprises at least one guide rail wherein the cable deflecting piece is to be fastened to the rail head or rail foot thereof.

From DE 38 05 576 C2 an attachment for a cable deflecting piece on a guide rail of a cable window lifter is known, whereat the guide rail is provided with a recess, into which a grip protrusion projecting from the cable deflecting piece with a nose projecting across to the longitudinal direction of the guide rail from the grip protrusion is inserted, which overlaps an edge section of the recess on the external side of the guide rail facing away from the cable deflecting piece. By a pivoting movement of the cable deflecting piece about the edge section into the mounting position with a pivoting axis parallel to the longitudinal direction of the guide rail the latching protrusion overlaps a terminal edge section of the guide rail for a locking abutment against the external side of the guide rail. For securing the cable deflecting piece in the mounting position the latching protrusion provided on the cable deflecting piece engages into a latching counter area of the guide rail when the stop protrusion is inserted into the recess, wherein a spring tongue formed in the latching protrusion blocks a pivoting movement out of the mounting position.

From DE 80 32 764 U1 a cable deflecting piece for a Bowden cable window lifter is known, which is attached to an end of the guide rail for connecting to a guide rail of the window lifter and comprises an undercut latching protrusion on the side thereof facing the guide rail, wherein between said protrusion and the cable deflecting piece a free gap is obtained, which corresponds to the material thickness of the guide rail. The latching protrusion comprises on the end of its inner side a protrusion, which engages into a recess of a guide rail when attaching the cable deflecting piece to the guide rail and secures thereby the cable deflecting piece against a removal from the guide rail. In addition an undercut nose arranged on the cable deflecting piece with a distance from the latching protrusion engages with the recess of the guide rail when attaching the cable deflecting piece and secures thus the cable deflecting piece against a tilting after attachment to the guide rail.

SUMMARY

Object of the present invention is to provide a cable deflecting piece, which allows fora simple and fast assembly when mounting the cable deflecting piece on the rail head or rail foot of a guide rail and guarantees a high stability of the connection between the cable deflecting piece and the guide rail.

The solution according to the invention allows for an insertion of the cable deflecting piece with a rotary and bearing pin projecting from the base body into a rotary and bearing opening of the rail head or rail foot in a position tilted in relation to the longitudinal extension of a guide rail and performs thus an exact prepositioning without that a readjustment of the cable deflecting piece for the mounting thereof on the rail head or rail foot is required. By subsequent rotation or pivoting of the cable deflecting piece about the mounting rotation axis formed by the rotary and bearing pin projecting from the base body and the rotary and bearing opening on the rail head or rail foot a rotation prevention means is activated in a final mounting position, which secures the connection of the cable deflecting piece to the rail head or rail foot against an undesired rotation of the cable deflecting piece about the mounting rotation axis, and a secure, stable abutment of the base body against the rail head or rail foot perpendicular to the longitudinal extension of the guide rail, that means in X-direction as well as also in particular in Y-direction of a motor vehicle with a cable window lifter installed in a motor vehicle door is guaranteed by the device formed on the base body for securing the abutment.

Due to the form fitting connection of the rotary and bearing pin projecting from the base body to the rotary and bearing opening formed in the rail head or rail foot the cable deflecting piece is secured against a removal from the rail head or rail foot, the assembly thereof is alleviated due to an exact guidance of the cable deflecting piece by the formation of the mounting rotation axis, an unintended deassembly of the cable deflecting piece from the guide rail via back rotation is prevented by the rotation prevention and due to the device formed on the base body for securing the abutment of the base body against the rail head or rail foot a tilting of the cable deflecting piece perpendicular to the longitudinal extension of the guide rail that means perpendicular to the guiding plane of the guide rail is prevented. Due to this multiple securing of the cable deflecting piece, which is affected by a simple mounting with an inserting and pivoting movement, a secure connection of the cable deflecting piece to the rail head or rail foot of a guide rail is also guaranteed under load.

Alternatively or in addition to a corresponding design of the rotation prevention means and the device for securing the abutment of the base body against the rail head or rail foot a stop area can be formed on the base body of the cable deflecting piece for a further alleviation of the mounting, which abuts in the final mounting position against a part of the terminal edge of the rail head or rail foot and prevents thus a further rotation or pivoting of the cable deflecting piece about the mounting rotation axis.

The rotation prevention means comprises advantageously at least one latching element integrated into the base body which snaps after a pivoting of the cable deflecting piece about the mounting rotation axis in the final mounting position into a latching recess on the rail head or rail foot.

This design of the rotation prevention means prevents with a simple constructive means a back rotation of the cable deflecting piece into the starting mounting position and secures in combination with the stop area formed on the base body the cable deflecting means against a rotation about the mounting rotation axis in both rotation directions.

A first latching element consists of a latching nose projecting from the base body with a lead-in chamfer and a latching edge, which abuts in the final mounting position of the cable deflecting piece against a latching edge of a recess formed as a latching receptacle in the rail head or rail foot of the guide rail.

Alternatively, but preferably in addition to the first latching element, a second latching element is provided which consists of an elastic, bendable latching hook projecting from the base body, which when mounting the cable deflecting piece on the rail head or rail foot of the guide rail by pivoting the cable deflecting piece about the mounting rotation axis slides at least partially on a first side arm of the guide rail in an elastic relentless manner and abuts in the final mounting position against a latching stop on rail head or rail foot of the guide rail.

Due to the arrangement of in particular two latching elements a high degree of rotation security of the cable deflecting piece is provided such that also large cable forces occurring when operating the cable window lifter do not cause a rotation of the cable deflecting piece out of the final mounting position or operating position and thus the danger of an undesired release of the connection of the cable deflecting piece to the rail head or rail foot of the guide rail occurs.

The device for securing the abutment of the base body against the rail head or rail foot consists preferably of at least one rear grip originating from the base body and encompassing at least partially a terminal edge of the rail head or rail foot.

The rear grip is effective in connection with the stop area against a tilting of the cable deflecting piece in X-direction of a motor vehicle and against a removal or tilting of the cable deflecting piece in Y-direction of a motor vehicle.

The rear grip is thereby formed such that it is distanced after the insertion of the rotary and bearing pin into the rotary and bearing opening in position of the cable deflecting piece tilted in relation to the longitudinal extension of the guide rail and before rotating or pivoting the cable deflecting piece about the mounting rotation axis from the terminal edge of the rail head or rail foot and encompasses the terminal edge in the final mounting position.

Also the device formed as a rear grip for securing the abutment of the base body against rail head or rail foot can be formed as one piece or in multiple pieces, wherein in particular a multi-piece formation of the rear grip prevents a release of the base body from the abutment against the rail head or rail foot against a tilting in different directions in relation to the stop area of the rail head or rail foot and guarantees thereby the secure abutment of the cable deflecting piece in X- and in particular in Y-direction of the cable window lifter assembled into a motor vehicle door.

A first rear grip formed on the base body encompasses the terminal edge of a central arm of the guide rail and abuts with a section continuing parallel to the terminal edge of the central arm in the final mounting position against the side of the rail head or rail foot of the guide rail opposing the base body, wherein in between the first rear grip and the base body a slot for inserting the terminal edge of the central arm of the guide rail is provided.

The first rear grip secures a tight and lasting abutment of the base body and thus of the cable deflecting piece against the rail head or rail foot of the guide rail in Y-direction of a motor vehicle by encompassing the terminal edge of the central arm of the guide rail wherein the slot between the base body and the front side of the strip-like first rear grip receives the terminal edge.

As an alternative or preferably in addition to the first rear grip a second rear grip can be provided, which is formed as an arm projecting from the base body, which encompasses in the final mounting position a chamfer continuing from the terminal edge of the central arm to the latching stop of the first side arm at an obtuse angle to the terminal edge of the central arm and abuts in the final mounting position with a flat section against the side of the rail head or rail foot of the guide rail opposing the base body.

Since the second rear grip encompasses the terminal edge of the rail head or rail foot of the guide rail in the area of the chamfer it secures the abutment of the cable deflecting piece in Y-direction as well as the embedding of the base body of the cable deflecting piece into the U-profile of the guide rail and thus also in X-direction of the motor vehicle.

In order to prevent a collision of the second rear grip with the guide rail when inserting the rotation and bearing pin into the rotation and bearing opening in tilted position of the cable deflecting piece the second rear grip comprises an inclined edge corresponding to the obtuse angle of the chamfer such that when inserting the rotary and bearing pin of the cable deflecting piece into the rotary and bearing opening on the rail head or rail foot of the guide rail the inclined edge continues essentially parallel to the chamfer.

Altogether this guarantees that in a starting mounting position in which the cable deflecting piece is positioned on the guide rail in a tilted position in respect to the longitudinal extension of the guide rail and the rotary and bearing pin projecting from the base body of the cable deflecting pin is inserted into the rotary and bearing opening of the rail head or rail foot of the guide rail the rear grip collides with the guide rail. Only when pivoting the cable deflecting piece about the mounting rotation axis formed by the rotary and bearing pin and the rotary and bearing opening into the final mounting position the rear grip comes to an abutment against the side of the rail head or rail foot opposing the base body and secures thus the base body against a removal or tilting perpendicular to the guiding area of the guide rail.

For alleviating the insertion of the rotary and bearing pin projecting from the base body of the cable deflecting piece into the rotary and bearing opening on the rail head or rail foot the rotary and bearing pin is provided on the terminal side with a circumferential lead-in chamfer.

Besides the rotary and bearing pins serving as mounting aid and being effective as part of a position securing as well as latching and locking elements securing the connection of the cable deflecting piece to the rail head or rail foot of the guide rail the cable deflecting piece comprises as functional elements a carrier stop, which abuts against the terminal edges of an edge arm and a second side arm of the guide rail consisting of ZU-profile for a carrier of the cable window lifter adjustable along the guide rail, which is preferably arranged adjacent to the stop area, which is formed on the base body and abuts in the final mounting position against a part of the terminal edge of the rail head or rail foot, as well as a bended tubular guiding channel for a window lifter cable, which contains a Bowden support on the opening thereof directed away from the guide rail.

The cable deflecting piece is formed in one piece as injection moulding piece for a simple manufacturing and precise formation of the rotary and bearing pin and the latching and locking elements.

Alternatively the base body and the latching and locking elements can consist of one singular injection moulding piece, into which the rotary and bearing pin is inserted, in particular injected, as separate metal part, preferably made of steel.

BRIEF DESCRIPTION OF THE DRAWINGS

The idea on which the invention is based on and the different variants of the solution according to the invention shall be indicated and explained by the means of the embodiments illustrated in the Drawings.

DETAILED DESCRIPTION

Figure 1:
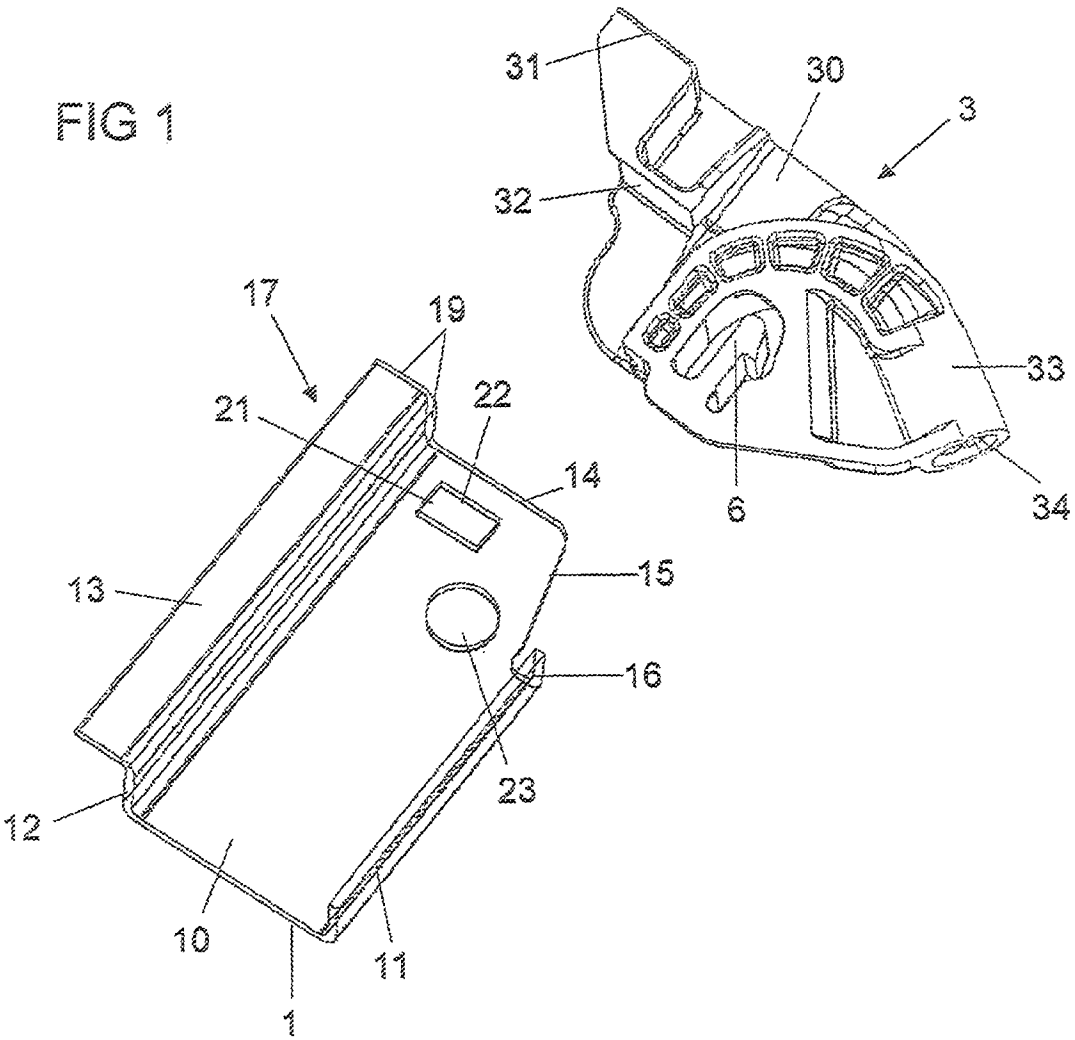
FIG. 1 shows a schematic isometric illustration of a rail head and a cable deflecting piece before mounting the cable deflecting piece on the rail head.
Figure 2:
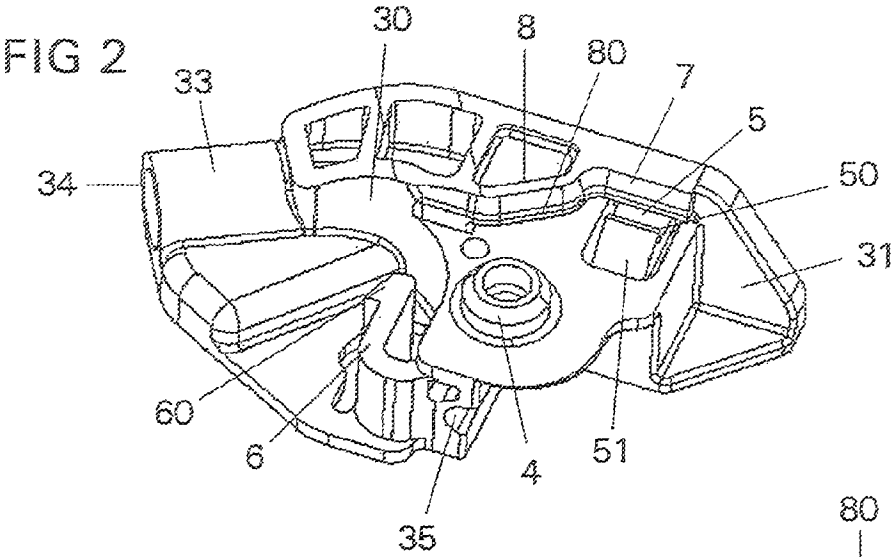
FIGS. 2 to 4 show isometric views of the front and back side of the cable deflecting piece.
Figure 4:
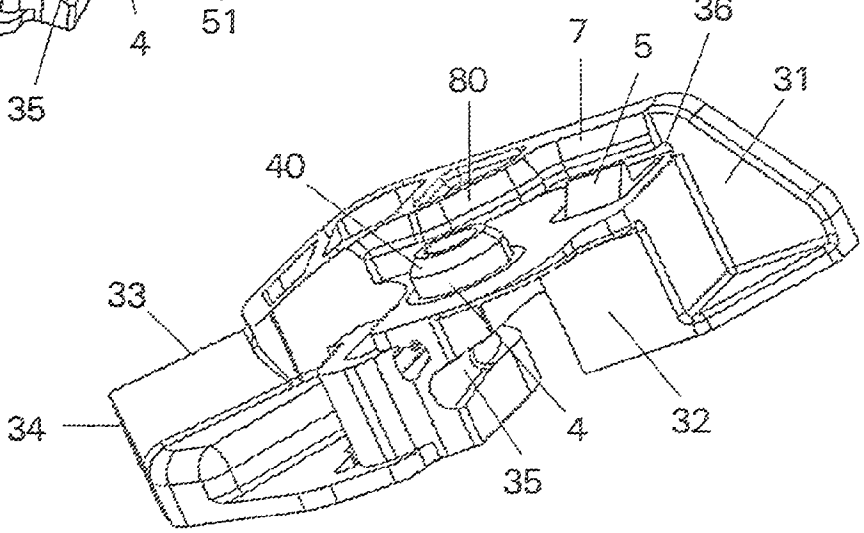
Figure 3:
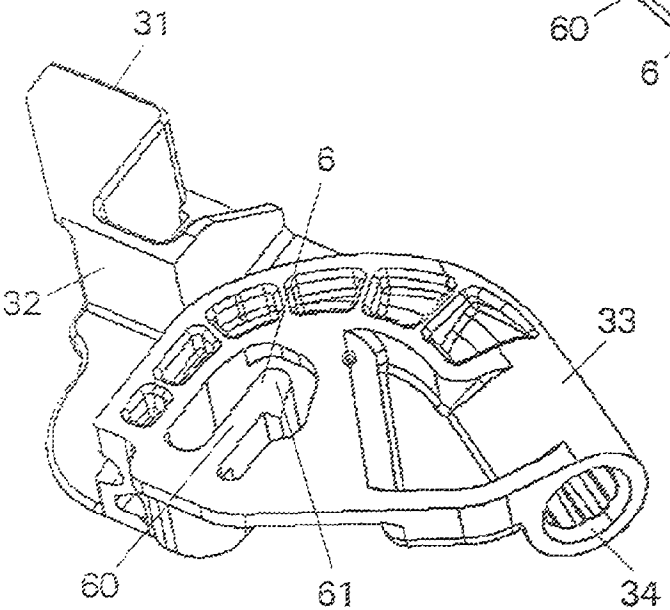

In FIGS. 1 to 12 the upper end of a guide rail designated as rail head 17 or the lower end of a guide rail 1 designated as rail foot 18 of an otherwise not illustrated single or double stranded cable window lifter is illustrated within a motor vehicle door. A carrier, which is also not illustrated, is movably arranged on the guide rail 1 in longitudinal direction of the guide rail, which is connected to a window pane, which is lifted and lowered according to the moving direction of the carrier. For this purpose the carrier is connected to a window lifter cable, which is guided in a closed loop and is guided by a manual or motored window lifter drive to a cable deflecting piece 3 illustrated in FIGS. 1 to 12 on the rail head 17 along the guide rail 1 to a corresponding cable deflecting piece on the rail foot 18 back to the window lifter drive. Between the two cable deflecting pieces 3 on rail head 17 and rail foot 18 the window lifter cable is connected to the carrier, for instance via a cable nipple supported in a nipple chamber of the carrier.

The window lifter cable can be guided in a Bowden cable cover between the cable deflecting pieces 3 and the cable lifter drive, which is supported by a Bowden support 34 according to FIGS. 1 to 4.

As deducible from the isometric illustration of FIG. 1 the guide rail 1 comprises a ZUprofile, which consists of a U-profile with a centre arm 10, wherein side arms 11, 12 vertically project from the ends thereof, and an edge arm 13 projecting vertically outwards from the side arm 12.

The rail head 17 or rail foot 18 comprise for mounting the cable deflecting piece 3 according to FIGS. 1 and 5 to 12 in the centre arm 10 a preferably rectangular recess 21 and a continuous rotary and bearing opening 23. A chamfer 15 continues from the terminal edge 14 of the centre arm 10 to the side arm 11, which is not connected to the edge arm 13, wherein on the side arm sided end of said chamfer a latching stop 16 is provided.

The cable deflecting piece 3 consists of a base body 30, which is arranged after connect ing the cable deflecting piece 3 to the rail head 17 or rail foot 18 in the mounting final position or operating position on the inner side of the ZU-profile of the guide rail 1 in the area of the U-profile between the side arms 11, 12. As in particular deducible from the isometric illustrations of FIGS. 2 to 4, a rotary and bearing pin 4 projects from the base body 30, wherein said pin comprises a circumferential chamfer 40 on its end facing away from the base body 30.

The rotary and bearing pin 4 is inserted—as explained in more detail in the following—in the mounting starting position in a, in respect to the mounting final position or operating position of the cable deflecting piece 3 into the rotary and bearing opening 23 on the rail head 17 or rail foot 18 such that the base body 30 comes to abutment against the inner side of the rail head 17 or rail foot 18.

The base body 30 contains a bended tubular cable channel 33, which comprises on one end thereof a Bowden support 34 and which passes on its other end into a sliding channel 35 for the window lifter cable. In the mounting final position or operating position of the cable deflecting piece 3 the sliding channel 35 is directed to the longitudinal extension of the guide rail 1, while the opening provided on the opposite end of the cable channel 33 points with the Bowden support 34 to the window lifter drive.

In the mounting final position or operating position a stop area 31 formed on the base body 30 abuts against the terminal edges 19 of the side arm 12 and edge arm 13 of the rail head 17 or rail foot 18 as terminal stop. Adjacent to the stop area 31 a stop 32 is formed stepwise for the carrier guided in a longitudinally adjustable manner on the guide rail 1.

Multiple latching and locking elements are integrated into the base body 30 of the cable deflecting piece 3, which serve in different functions for rotation prevention or for securing the abutment of the cable deflecting piece 3 in Y direction on the rail head 17 or rail foot 18. For rotation prevention a latching element integrated into the base body 30 is provided according to FIGS. 2 to 4, which is formed as latching nose 5 with a lead-in chamfer 50 and a latching edge 51 and snaps in the mounting final position into the recess 21 on the rail head 17 or rail foot 18 such that the latching edge 51 of the latching nose 5 abuts against a latching edge 22 of the recess 21 and thus a back rotation of the cable deflecting piece 3 out of the mounting final position or operating position into the mounting starting position is prevented.

In the same manner a second latching element acts, which is formed as latching hook 6 and comprises an elastic bar 60 and a latching head with a latching edge 61, which abuts in the mounting final position against the latching stop 16 on the terminal edge of the side arm 11 and also prevents a back rotation of the cable deflecting piece 3 out of the mounting final position into the mounting starting position.

For securing the abutment of the base body 30 against the inner side of the rail head 17 or rail foot 18 and thus for securing the cable deflecting piece 3 in direction vertical to the area of the guide rail, that means for securing the cable deflecting piece 3 in Y direction of the motor vehicle in case of a cable window lifter inserted into a motor vehicle door adjacent to the latching nose 5 a first strip-like rear grip 7 is provided, which encompasses the terminal edge 14 of the centre arm 10 of the rail head 17 or rail foot 18 and abuts against the section of the external side of the rail head 17 or rail foot 18 adjacent to the terminal edge 14. For receiving the terminal edge 14 and the sections following the terminal edge 14 an insertion slot 36 is provided on the internal side and external side of the rail head 17 or rail foot 18 according to FIG. 4.

A second rear grip 8 is provided adjacent to the first strip-like rear grip 7, which encompasses the chamfer 15 between the terminal edge 14 of the centre arm 10 and the latching stop 16 of the side arm 11 and abuts also against the external side of the rail head 17 or rail foot 18. The second rear grip 8 comprises an inclined edge 80, which faces in the mounting starting position the chamfer 15 and thus allows the insertion of the rotary and bearing pin 4 into the rotary and bearing opening 23.

Figure 6:
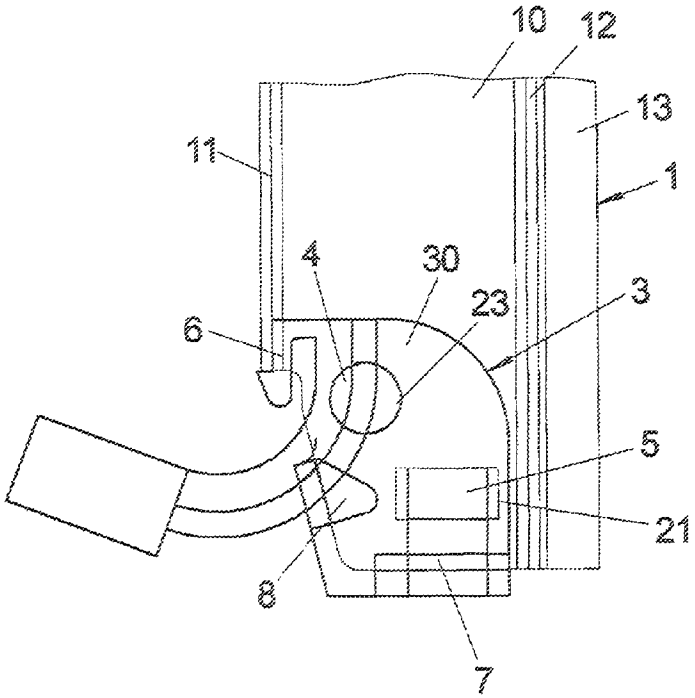
FIGS. 5 and 6 show schematic illustrations of a cable deflecting piece and a rail foot of a guide rail in a mounting starting position and an mounting final position or operating position of the cable deflecting piece.
Figure 5:
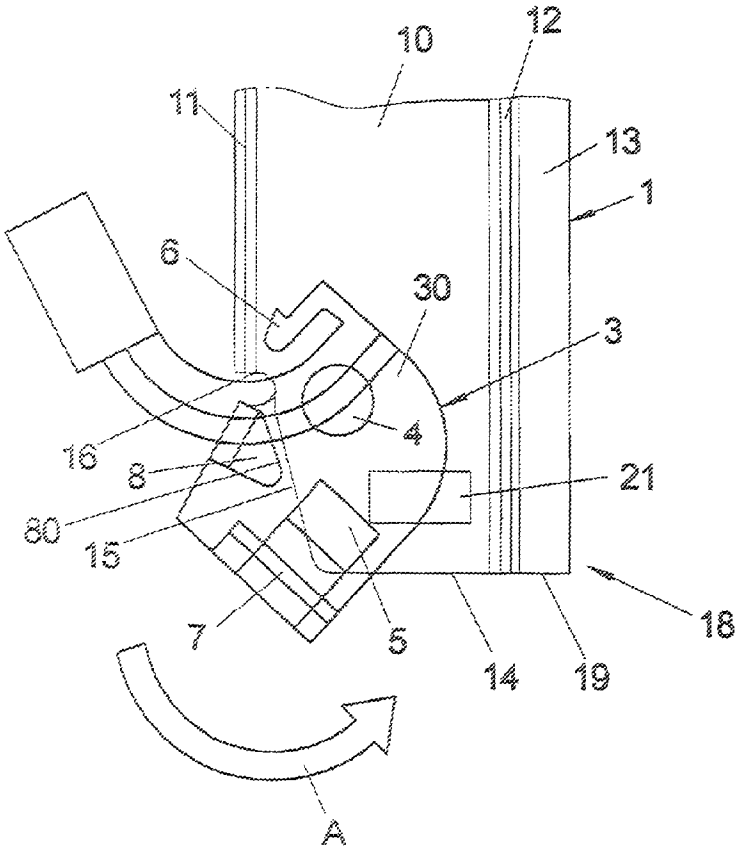

FIGS. 5 and 6 show in a schematic top view the previously, by the means of FIGS. 1 to 4 described mounting, latching and locking elements of the cable deflecting piece 3 and the rail head 17 or rail foot 18 of the guide rail 1 for aligning and mounting the cable deflecting piece 3 to the rail foot 18 of the guide rail 1 as well as the mounting steps starting from an mounting starting position illustrated in FIG. 5 into an mounting final position or operating position of the cable deflecting piece 3 in respect to the guide rail illustrated in FIG. 6.

FIG. 5 shows schematically the cable deflecting piece 3 in the mounting starting position, in which it is tilted in respect to the longitudinal extension of the guide rail 1 such that the inclined edge 80 of the second rear grip 8 is aligned almost parallel to the chamfer 15 on the rail foot 18 and the strip-like first rear grip 7 serving as Y protection is opposite to the crossing of the terminal edge 14 of the centre arm 10 to the chamfer 15 and the latching head of the latching hook 6 is opposite to the internal side of the side arm 11. In this tilted position of the cable deflecting piece 3 the rotary and bearing pin 4 is inserted into the rotary and bearing opening 23 of the rail foot 18, wherein the circumferential chamfer of the rotary and bearing pin 4 allows for the insertion into the rotary and bearing opening 23.

After inserting the rotary and bearing pin 4 into the rotary and bearing opening 23 until abutment of the base body 30 against the internal side of the rail foot 18 the cable deflecting piece 3 is pivoted in direction of arrow A about the mounting rotary axis formed by the rotary and bearing pin 4 and the rotary and bearing opening 23, wherein the latching head of the latching hook 6 slides along the internal side of the side arm 11 and the second rear grip 8 slides with its inner face along the external side of the centre arm 10 and the latching nose 5 slides along the internal side of the centre arm 10. The insertion slot 36 formed between the strip-like first rear grip 7 and the base body 30 moves thereby over the terminal edge 14 of the centre arm 10.

The rotation of the cable deflecting piece 3 is continued until the stop area 31 abuts against the terminal edge 19 of the side arm 12 and edge arm 13, the latching nose 5 snaps into the recess 21 of the rail foot 18 and the latching edge 61 engages at the latching head of the latching hook 6 with the latching stop 16 at the end of the side arm 11. In this mounting final position or operating position of the cable deflecting piece 3 illustrated in FIG. 6 the second rear grip 8 abuts with its inner face against the external side of the centre arm 10 and the strip-like first rear grip 7 abuts for Y-protection of the cable deflecting piece 3 against the section of the external side of the rail foot 18 being adjacent to the terminal edge 14 of the centre arm 10, while the insertion slot 36 encompasses the terminal edge 14 of the centre arm 10. Herewith the cable deflecting piece 3 is secured against a removal of the base body 30 from the internal side of the rail foot 18 and against a tilting in Y-direction as well as against a rotation of the cable deflecting piece 3 by engagement of the latching nose 5 into the recess 21 and abutment of the latching edge 51 of the latching nose 5 against the latching edge 22 of the recess 21 as well as of the latching edge 61 of the latching hook 6 against the latching stop 16 of the side arm 11.

After inserting the rotary and bearing pin 4 in tilted position of the cable deflecting piece 3 into the rotary and bearing opening 23 on the rail foot 18 a simple pivoting movement of the cable deflecting piece 3 about the mounting rotation axis formed by the rotary and bearing pin 4 as well as the rotary and bearing opening 23 provides a locking of the cable deflecting piece 3 in the mounting final position with a rotarion protection and protection in X-, Y- and Z-direction or protection against a tilting or removal of the base body 30 from the internal side of the rail foot 18 such that the cable forces acting during the operation of the cable window lifter onto the cable deflecting piece 3 can be received steadily without changing the position of the cable deflecting piece 3 in respect to the rail foot 18 of the guide rail 1.

Figure 8:
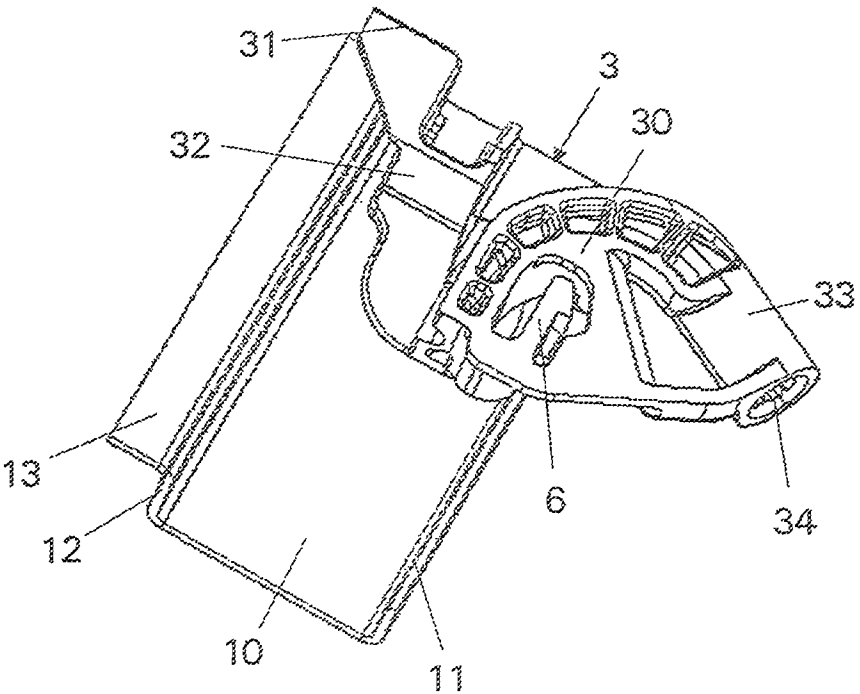
FIGS. 7 to 10 show isometric illustrations of the front and back side of the rail head of a guide rail with a cable deflecting piece attached to the rail head in tilted position in the mounting starting position and fastening the cable deflecting piece to the rail head in the mounting final position.
Figure 7:
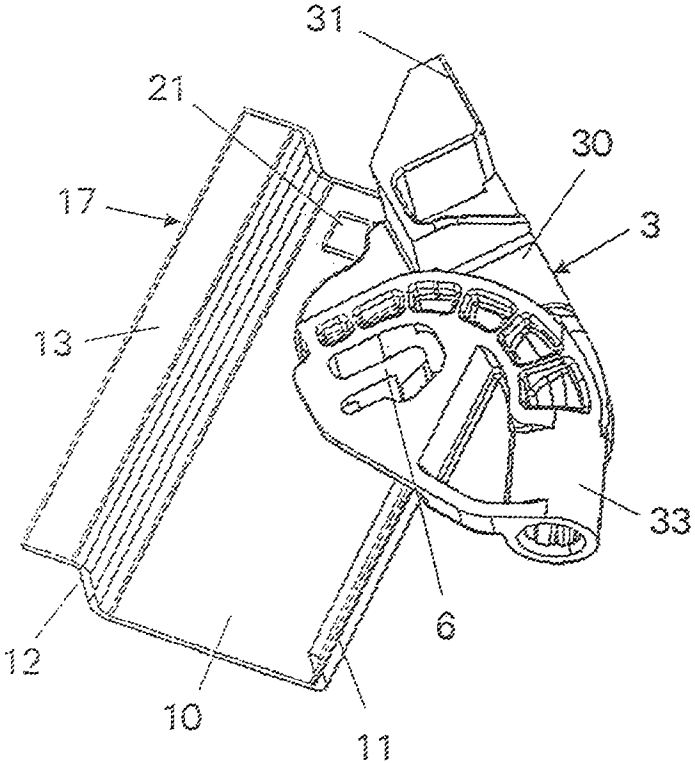
Figure 10:
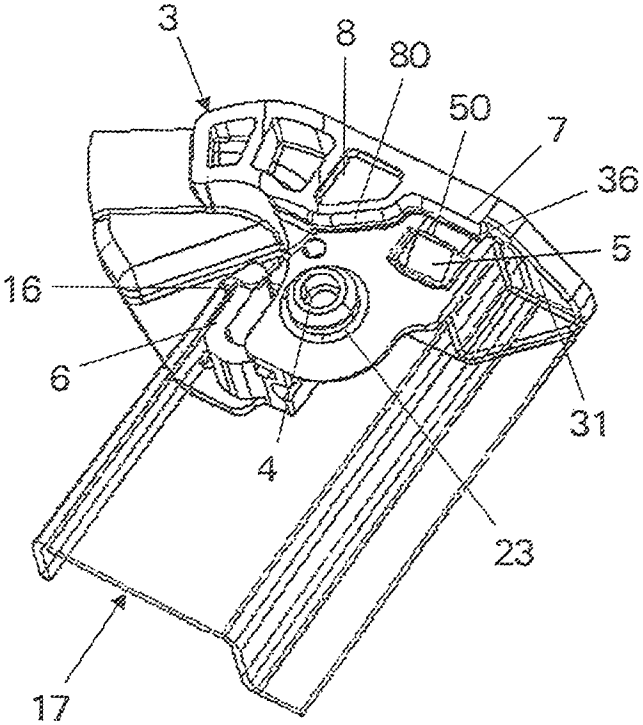
Figure 9:
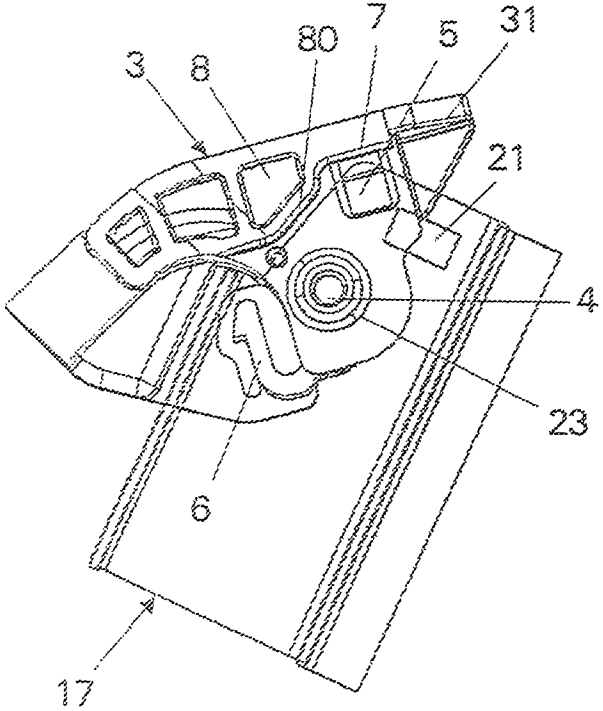

In FIGS. 7 and 8 there are illustrated in isometric views of the internal side of the rail head 17 and in FIGS. 9 and 10—with schematically transparent illustration of the rail head 17—there are illustrated in isometric views of the external side of the rail head 17 the mounting of the cable deflecting piece 3 on the rail head 17 in the mounting starting position (FIGS. 7 and 9) as well as in the mounting final position or operating position (FIGS. 8 and 10).

FIGS. 7 and 9 show in isometric view of the internal side and external side of the rail head 17 of the guide rail 1 the mounting starting position, in which the cable deflecting piece 3 is positioned in a tilted position in respect to the mounting final position on the rail head 17 and the rotary and bearing pin 4 is inserted into the rotary and bearing opening 23, wherein the inclined surface 80 of the rear grip 8 is directed almost parallel to the chamfer 15 of the terminal edge of the rail head 17 and opposes the latching hook 6 of the internal side of the side arm 11.

By pivoting the cable defecting piece 3 about the mounting rotation axis formed by the rotary and bearing pin 4 and the rotary and bearing opening 23 the latching hook 6 is guided along the internal side of the side arm 11 and the latching nose 5 is guided in a circular arc to the recess 21. Shortly before approaching the mounting final position the inserting slot 36 is moved over the terminal edge 14 of the centre arm 10 until the stop area 31 comes to abutment against the terminal edge 19 of the side arm 12 and edge arm 13 in the mounting final position illustrated in FIGS. 8 and 10, the latching nose 4 snaps into the recess 31 and the latching edge 51 of the latch nose 5 abuts against the latching edge 22 of the latching opening 21. Simultaneously, the latching edge 61 of the latching hook 6 engages via the latching stop 16 at the end of the side arm 11 and secures together with the latching nose 5 the cable deflecting piece 3 against a rotation about the mounting rotation axis.

Thereby, the strip-like first rear grip 7 comes to an abutment against the section of the external side of the rail head 17 being adjacent to the terminal edge 14 of the centre arm 10 and secures in interaction with the second rear grip 8 the cable deflecting piece in Y-direction as well as the abutment of the base body 30 of the cable deflecting piece 3 against the internal side of the rail head 17, which is formed by the U-profile of the centre arm 10 and the two side arms 11, 12.

Figure 12:
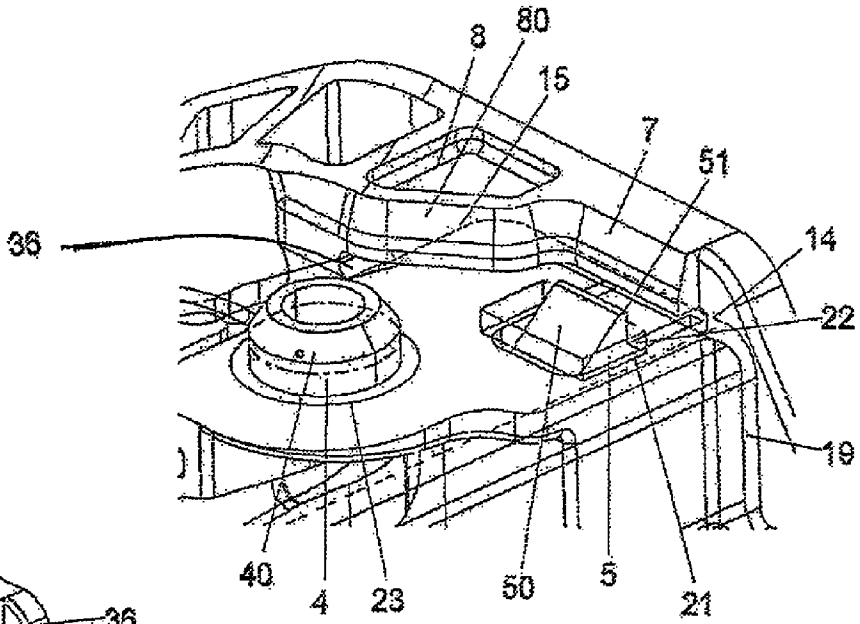
FIG. 12 shows an enlarged isometric illustration of a part of a cable deflecting piece connected to the rail head.
Figure 11:
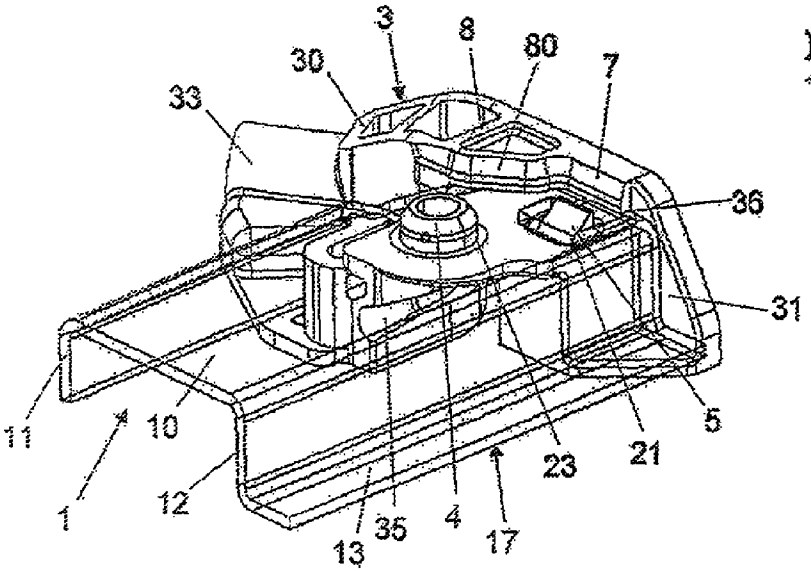
FIG. 11 shows a schematic isometric illustration of the cable deflecting piece connected to the rail head of a guide rail in the mounting final position.

FIG. 11 shows the mounting final position or operating position of the cable deflecting piece 3 and FIG. 12 shows an enlarged section of the illustration according to FIG. 11 with a transparent illustration of the rail head 17 of the guide rail, respectively.

In the mounting final position the sliding channel 35 of the cable deflecting piece 3 is aligned in longitudinal direction of the guide rail 1, while the cable channel 33 is directed in an inclined manner away from the rail head 17. The stop are 31 of the cable deflecting piece 3 abuts against the terminal edges 19 of the side arm 12 and the edge arm 13. The rotary and bearing pin 4 with its chamfer 40 projects through the rotary and bearing opening 23 and the latching nose 5 serving the rotation protection is snapped in to the recess 21 and abuts against the latching edge 22 of the recess 21 with its latching edge 51. The first strip-like rear grip 7 encompasses the terminal edge 14 of the centre arm 10 and abuts against the sections of the external and internal side of the centre arm 10 of the rail head 17, which flank the terminal edge 14, wherein the inserting slot 36 on the cable deflecting piece 3 receives the terminal edge 14.

FIG. 12 shows as a dashed line the chamfer 15 of the rail head 17 encompassed by the second rear grip 8 as well as the inclined edge 80 of the second rear grip 8, which encompasses diagonally this section of the rail head 17.

The invention claimed is:

1. A cable deflecting piece for a cable operated window lifter having at least one guide rail, wherein the cable deflecting piece is configured to be fastened on a rail head or rail foot of the cable operated window lifter, the cable deflecting piece comprising:

a base body configured to abut the rail head or rail foot during mounting and after fastening the cable deflecting piece on the rail head or rail foot of the at least one guide rail;

a rotary and bearing pin which projects from the base body and which can be inserted into a rotary and bearing opening of the rail head or rail foot in a position of the cable deflecting piece tilted in relation to a longitudinal extension of the at least one guide rail, wherein the rotary and bearing pin and the rotary and bearing opening form a mounting rotation axis about which the cable deflecting piece is pivotable after inserting the rotary and bearing pin into the rotary and bearing opening until abutment of a stop area of the base body against a terminal end edge of the rail head or rail foot during the mounting of the cable deflecting piece on the rail head or rail foot of the at least one guide rail;

at least one latching element which prevents further rotation of the cable deflecting piece about the mounting rotation axis in a final mounting position after a pivoting of the cable deflecting piece about the mounting rotation axis; and a device in addition to the at least one latching element, formed on and originating from the base body configured for securing the base body against the rail head or rail foot in such a way that a removal of the cable deflecting piece perpendicular to the longitudinal extension of the at least one guide rail is prevented after rotation of the cable deflecting piece into its final mounting position.

2. The cable deflecting piece according to claim 1, wherein the at least one latching element is integrated into the base body and which, after the cable deflecting piece is pivoted about the mounting rotation axis in the final mounting position, snaps into a latching receptacle on the rail head or rail foot or strikes the latching receptacle.

3. The cable deflecting piece according to claim 2, wherein the at least one latching element comprises a first latching element comprising a latching nose projecting from the base body with a lead-in-chamfer and a first latching edge which, in the final mounting position of the cable deflecting piece, abuts against a second latching edge located on a recess formed as the latching receptacle in the rail head or rail foot of the at least one guide rail.

4. The cable deflecting piece according to claim 2, wherein the at least one latching element further comprises a second latching element comprising an elastically bendable latching nose projecting from the base body which, when mounting the cable deflecting piece on the rail head or rail foot of the at least one guide rail by pivoting the cable deflecting piece about the mounting rotation axis, slides at least along a section on a first side arm of the at least one guide rail and, in the final mounting position, snaps or strikes on a latching stop on the rail head or rail foot of the guide rail.

5. The cable deflecting piece according to claim 1, wherein the device for securing the base body against the rail head or rail foot comprises at least one rear grip originating from the base body and at least partially encompassing the terminal end edge of the rail head or rail foot.

6. The cable deflecting piece according to claim 5, wherein after inserting the rotary and bearing pin into the rotary and bearing opening in position of the cable deflecting piece tilted in relation to the longitudinal extension of the at least one guide rail and before pivoting the cable deflecting piece about the mounting rotation axis the at least one rear grip is configured to be spaced from the terminal end edge of the rail head or rail foot and, in the final mounting position, is configured to encompass the terminal end edge.

7. The cable deflecting piece according to claim 6, wherein the at least one rear grip comprises a first rear grip encompassing the terminal end edge of a central arm of the at least one guide rail and which, in the final mounting position, abuts a section extending parallel to the terminal end edge of the central arm against a side of the rail head or rail foot of the at least one guide rail opposing the base body.

8. The cable deflecting piece according to claim 7, further comprising an insertion slot between the first rear grip and the base body and configured to receive the terminal end edge of the central arm of the at least one guide rail.

9. The cable deflecting piece according to claim 5, wherein the at least one rear grip further comprises a second rear grip formed on an arm projecting from the base body which, in the final mounting position, encompasses a chamfer continuing from the terminal end edge of a central arm to a latching stop of a first side arm at an obtuse angle to the terminal end edge and, in the final mounting position, abuts against a side of the rail head or rail foot of the at least one guide rail opposing the base body.

10. The cable deflecting piece according to claim 9, wherein the second rear grip comprises an inclined edge corresponding to the obtuse angle of the chamfer such that when inserting the rotary and bearing pin of the cable deflecting piece into the rotary and bearing opening on the rail head or rail foot of the at least one guide rail, the inclined edge extends essentially parallel to the chamfer.

11. The cable deflecting piece according to claim 1, wherein the rotary and bearing pin comprises a circumferential lead-in chamfer on a terminal side.

12. The cable deflecting piece according to claim 1, wherein the base body comprises a carrier stop configured to engage a carrier adjustable along the guide rail.

13. The cable deflecting piece according to claim 12, wherein the carrier stop is arranged adjacent to a stop area formed on the base body and abuts against a part of the terminal end edge of the rail head or rail foot in the final mounting position.

14. The cable deflecting piece according to claim 1, wherein a bended, tubular cable channel for a window lifter cable is arranged in the base body.

15. The cable deflecting piece according to claim 14, wherein the cable channel comprises a Bowden support on its opening directed away from the guide rail.

16. The cable deflecting piece according to claim 1, wherein the cable deflecting piece is formed in one piece as an injection molding piece.

17. The cable deflecting piece according to claim 1, wherein the base body, the at least one latching element, and a locking element of the cable deflecting piece are a singular injection molding piece, into which the rotary and bearing pin is inserted as a separate metal part.

18. The cable deflecting piece according to claim 17, wherein the rotary and bearing pin is inserted into the injection-molding piece by injection.

* * * * *